United States Patent [19]

Laughton

[11] Patent Number: 4,996,797

[45] Date of Patent: Mar. 5, 1991

[54] APPARATUS FOR SHARPENING EDGE TOOLS

[75] Inventor: Christopher C. Laughton, Cornwall, England

[73] Assignee: Martek Limited, Cornwall, England

[21] Appl. No.: 320,952

[22] Filed: Mar. 9, 1989

[30] Foreign Application Priority Data

Mar. 10, 1988 [GB] United Kingdom ..... 8805728

[51] Int. Cl.[5] ..... B24B 7/00

[52] U.S. Cl. ..... 51/128; 51/240 T; 51/238 R

[58] Field of Search ..... 51/128, 218 R–218 T, 51/109 R, 102 R, 240 T, 238 R

[56] References Cited

U.S. PATENT DOCUMENTS 2,911,771 11/1959 Amiet ..... 51/102

FOREIGN PATENT DOCUMENTS 154967 9/1985 European Pat. Off. ..... 51/128

846800 9/1939 France ..... 51/128

*Primary Examiner*—William E. Terrell

*Assistant Examiner*—M. Rachuba

*Attorney, Agent, or Firm*—Gifford, Groh, Sprinkle, Patmore and Anderson

[57] ABSTRACT

Apparatus for sharpening an edge tool comprises a rotary grindstone mounted so as to be rotatable about a first axis of rotation, and a tool mount for a tool to be sharpened, in which the tool mount is turnable about an axis whereby to permit the edge tool to be turned so that a face to be ground moves in an arc lying in a plane parallel to that part of the grindstone against which the face is to be ground. The rotatable grindstone has a hollow cup-shape and is mounted at the end of a spindle in a body which can be clamped by brackets to a workbench or other support surface leaving the spindle exposed to be gripped by a pistol drill or other drive means.

11 Claims, 4 Drawing Sheets

APPARATUS FOR SHARPENING EDGE TOOLS

BACKGROUND OF THE INVENTION

Hand-held edge tools such as chisels and plane irons are usually supplied by the manufacturer with a flat bevel face lying at 25° to the plane defined by the opposite major face of the tool, the edge of the tool is then honed at 30° on a finer stone. Although large scale automatic machinery for grinding the bevel face and honing the edge of a hand tool are known, equipment available for the owner of a set of hand tools to sharpen these is primitive in the extreme. Indeed, the conventional technique for sharpening hand-held edge tools comprises stroking or rubbing the edge on a flat stationary stone to form the honed edge. Repeated sharpening operations result in the honed edge growing very much larger as the material is worn away, so that the bevel face becomes considerably reduced. Re-grinding the bevel face is a time consuming and tedious operation, and attempts to perform this by hand are almost inevitably unsatisfactory due to the inability of the operator to maintain the angle of the tool precisely constant during the whole of the stroke required to provide relative motion between the stone and the tool. Unless the operator is highly skilled even the honing operation performed on the very edge of the tool is insufficiently accurate when performed by hand to provide a satisfactory sharpened edge, and vary often the honed tip is rounded due to the tendency of the operator to rock the tool slightly during its forward stroke when in contact with the stone.

Various attempts have been made to produce apparatus suitable for an individual tool owner to sharpen edge tools by mechanical means. One such tool is described in British Patent No 1293729, which shows the provision of a pair of rotary grindstones one at each end of a motor shaft in a configuration similar to a conventional bench grinder, in front of which is positioned a tool mount carried on a transverse guide bar extending parallel to the axis of rotation of the grindstones. An edge tool can then be fitted on the mount and is displaceable across the cylindrical surface of one or other of the rotary grindstones held rigidly in a predetermined orientation during grinding. This known tool has the disadvantage that, because it is passed over the cylindrical surface of the grindstone the face ground on the bevel edge of the tool is concavely curved to form a so-called hollow ground face, which weakens the edge of the tool and allows it to become blunt more rapidly than an edge defined by meeting flat surfaces. There is also the possibility that a variation in pressure applied by the user as the edge tool is traversed across the grindstone will result in differing amounts of material being removed from the edge of the tool at different transverse positions so that a straight true edge is not always achieved, especially for wider tools such as plane irons. In an attempt to overcome this problem the tool holder described in European Patent application 225806 incorporates a stop member for limiting the rotation of a tool holder about a tool guide formed as a cylindrical bar, but this tool too provides a bevel face which is hollow ground and, furthermore, involves considerable complexity in the tool mount.

Flat bevel faces can be ground on the edge of a tool by the machine described in UK Patent No. 1093220. This, however, is a commercial machine for grinding a bevel face on a plurality of tufting knives used for cutting the pile in a tufting machine. A cup-shape grindstone is driven to rotate closely adjacent a tool holder in the form of a frusto-conical plate having a plurality of grooves in its conical surface, into which grooves several individual tufting knives may be fitted, to be clamped by a surrounding band. Up to 16 such grooves are provided and packs of up to 23 knives may be carried in each groove allowing up to 368 knives to be sharpened simultaneously upon rotation of the tool holder. The depth of cut of the grindstone which determines the amount of material removed from the edge of each tool as it is traversed over the flat annular face of the cup-shape stone is determined by adjusting the position of the holder along its axis of rotation. This machine is complex and unsuitable for use by an individual wishing to sharpen a single hand tool.

OBJECT OF THE INVENTION

A primary object of the present invention is to provide apparatus for sharpening a hand-held edge tool which is suitable for an individual tool owner to sharpen a single edge tool quickly and conveniently without requiring any adjustments or complicated set up procedures, but nevertheless producing a reliable and true sharp edge on the hand tool regardless of its width and/or length of the tool.

SUMMARY OF THE INVENTION

According to one aspect of the present invention, therefore, apparatus for sharpening an edge tool, comprising a rotary grindstone mounted so as to be rotatable about a first axis of rotation, and means for mounting an edge tool to be sharpened, is characterised in that the said tool mounting means permit the edge tool to be turned about a second axis of rotation orthogonal to a flat face ground on the edge tool upon contact with the rotary grindstone when turned about the said second axis.

Such apparatus can be used easily to set up a predetermined relative position between a tool and the grindstone, and the tool mount offers accurate, repeatable, secure and stable mounting for a tool to be sharpened so that a true edge can be ground in a straight line (without, of course, necessarily traversing the ground face of the tool in a straight line over the grindstone).

In a preferred embodiment of the invention the said tool engagement face of the tool mount has a shoulder against which a lateral edge of the tool may abut to locate it in a predetermined lateral position on the tool mount. This offers a simple and secure location of a tool of any width by determining the position of one side of the tool to be sharpened regardless of its other dimensions.

A tool to be sharpened may simply be held by hand in contact with the tool engagement face and the shoulder thereof in order to locate it in position for grinding. In a preferred embodiment of the invention, however, tool retaining means are provided for retaining a tool to be sharpened in contact with the tool engagement face of the tool mount, the said tool retaining means nevertheless permitting relative displacement of the tool and tool mount parallel to the plane of the tool engagement face whereby the proximity of the edge to be sharpened and the rotary grindstone may be adjusted for determining the amount of material removed as the tool is passed over the said flat face of the grindstone. This movement of the tool parallel to its own length may be achieved simply and easily by hand, avoiding the necessity for complex screw action adjusters or other means for displacing the spindle about which the tool mount is turnable.

One simple form of tool retaining means for the apparatus of the present invention comprise means for generating a magnetic attractive force between a ferromagnetic tool body and the said tool engagement face. Such magnetic attractive force may be generated by an electromagnet so that it can be applied selectively, or may be provided by a permanent magnet.

In a preferred embodiment of the invention the said rotary grindstone is supported for rotation by a machine body. The machine body may have integral brackets for attachment of the machine body to a support surface such as a workbench. It is also preferred that the tool mount is itself supported on the machine body for turning movement about the said second axis. It would be possible, of course, to make the tool mount separately from the machine body carrying the rotary grindstone, and such a two-part structure may readily be adapted to be mounted, for example on a workbench, so that there is a fixed inter-relationship between the two for use.

The rotary grindstone is preferably carried on a grindstone spindle a free end of which projects from bearing means therefor for attachment to a rotary drive device. It has been found that the widely accepted pistol drill is a suitable drive source for the sharpening apparatus of the present invention, and the free end of the grindstone spindle may therefore be provided simply as a plain projecting end suitable to be gripped by the chuck of a pistol drill.

Embodiments of the present invention which are self-driven may also be provided in such embodiments the rotary grindstone may be mounted on the output shaft of a drive motor for rotation therewith.

In a simple embodiment of the invention the tool engagement face provides a single unique angle of inclination for a tool intended to be ground on a flat face of the rotary grindstone: alternatively, however, there may be provided means for varying the inclination of the tool engagement face of the tool mount so that the angle of inclination of a bevel face ground on the edge of a tool may be changed. Such variation may comprise displacement of the tool engagement face at least between two predetermined end positions each of which lies at an acute angle to the plane perpendicular to the said first axis of rotation such as to define a predetermined grinding angle on an edge tool held with a major face in contact with the said tool engagement face of the tool mount. Such two angles may, typically, be the conventional chisel bevel angles of 25° for the bevel face and 30° for the honed edge.

In the preferred embodiment of the invention the rotary grindstone is a circular disc-like stone having a circular recess in a major face thereof surrounded by a flat annular surface constituting the working face of the stone contacted in use by the edge tool to be sharpened.

According to a second aspect of the present invention a method of sharpening an edge tool comprises the steps of locating a major face of an edge tool against an inclined tool engagement face of a tool mount inclined at an acute angle to the plane perpendicular to the axis of rotation of a rotary grindstone, retaining the tool by friction and/or magnetic attraction against the tool engagement face and sweeping the edge of the tool across a flat face of the rotary grindstone in contact therewith and with the tool engagement face of the tool mount whereby to grind a bevel face on the edge of the tool.

Other features and advantages of the invention will become apparent from a detailed study of the following description in which reference is made to the accompanying drawings provided purely by way of non-limitative example.

DESCRIPTION OF THE PREFERRED EMBODIMENT

Figure 1:
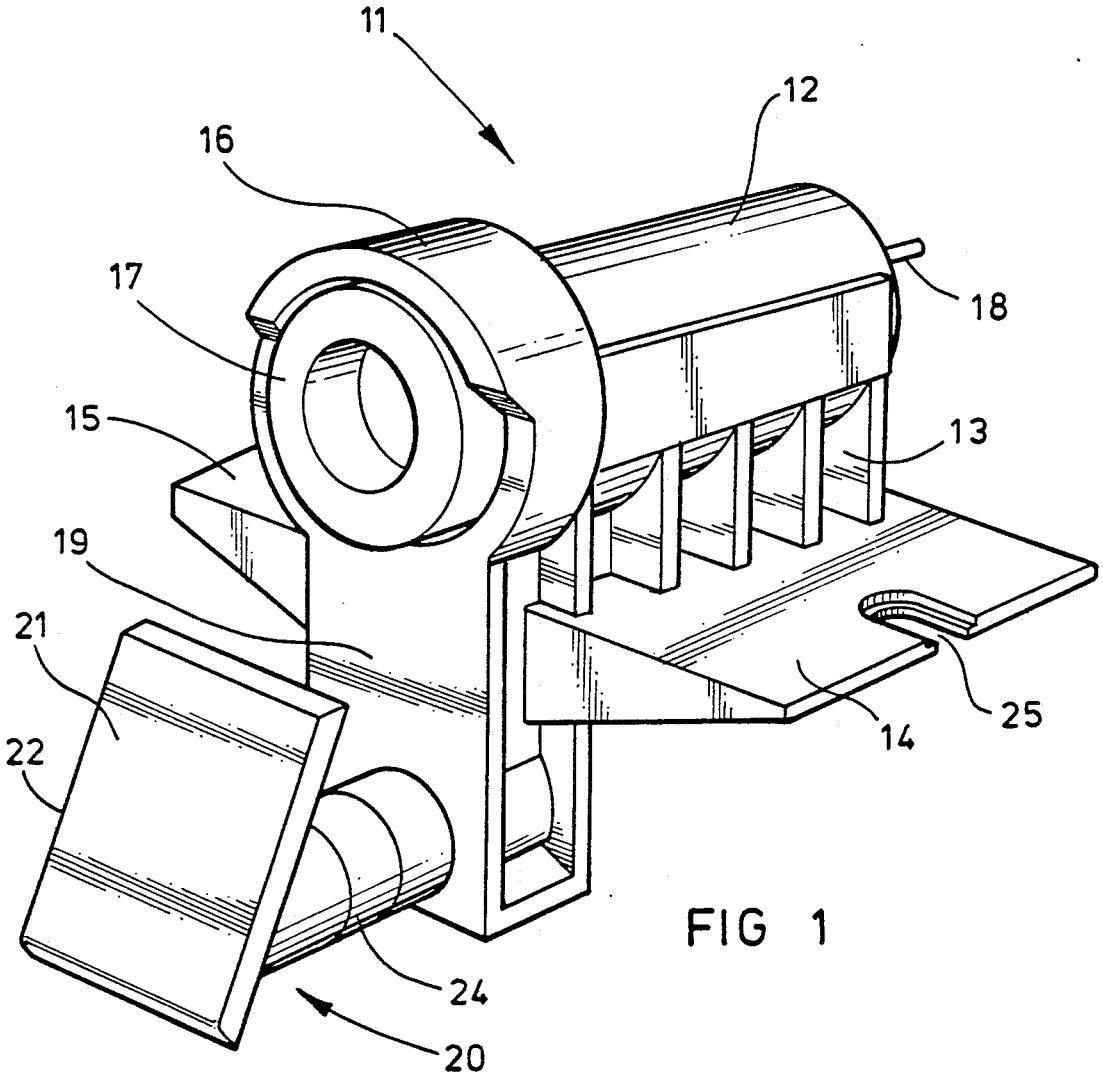
FIG. 1 is a perspective view in schematic outline showing the embodiment of the invention.
Figure 2:
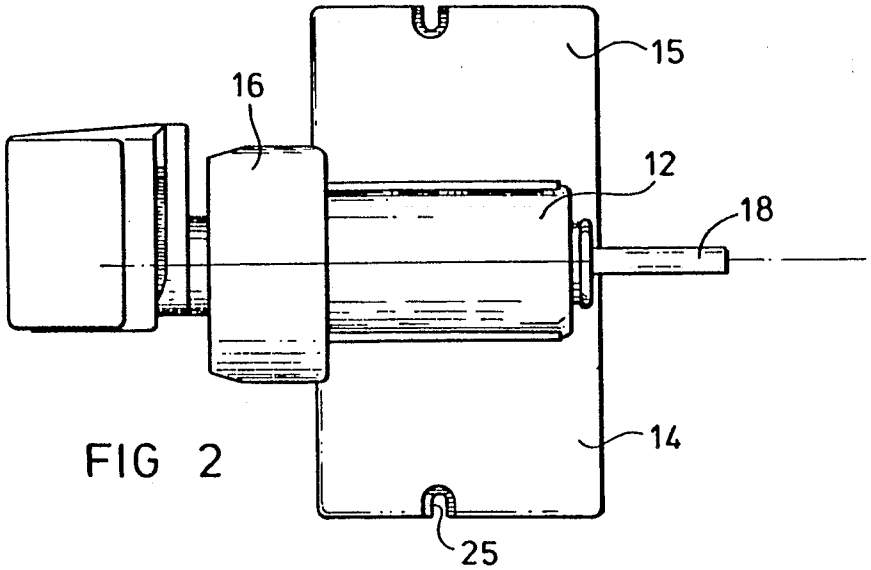
FIG. 2 is a plan view of the embodiment illustrated in FIG. 2.

Referring now to the drawings the apparatus shown comprises a tool sharpening machine generally indicated With the reference numeral 11 in the form of a generally cylindrical machine body 12 supported by an array of flat webs 13 on a pair of laterally projecting mounting brackets 14, 15.

The machine body 12 has, at one end, an enlarged stone casing 16 housing a cup-shape rotary grindstone 17 which is mounted for rotation on a spindle 18 the axis of which coincides with the axis of the cylindrical machine body 12. Integrally formed with the stone casing 16 is a downwardly projecting tool mount support 19 carrying a tool mount generally indicated 20 in the form of a tool holder plate 21 supported at one edge 22 by a tool holder plate support web 23 which is in turn carried by a cylindrical tool mount spindle carrier 24 secured to the tool mount support 19.

Figure 3:
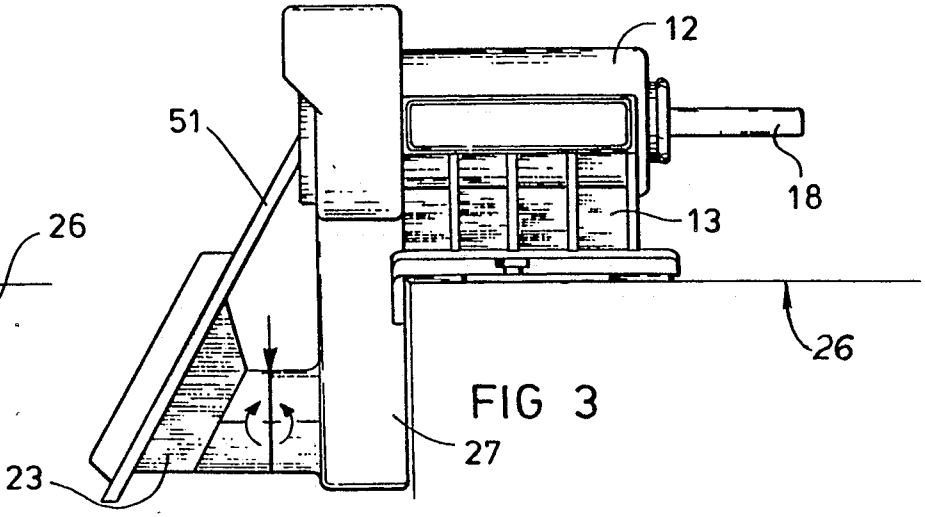
FIG. 3 is a side view of the embodiment illustrated in FIG. 1.
Figure 4:
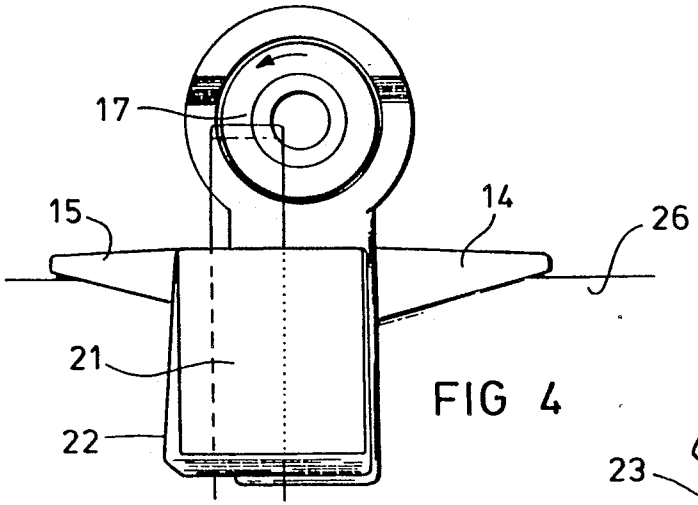
FIG. 4 is a front view of the embodiment illustrated in FIG. 1.

The two machine body mounting brackets 14 are coplanar and in their oppositely facing free edges are provided with shouldered notches 25 for receiving fixing elements (not shown) by which the tool sharpening machine 11 can be secured to an underlying support surface 26 as illustrated in FIGS. 3 and 4. As will be seen from FIG. 3, the tool mount support 19 has a rear face 27 which lies at a right angle to the lower faces of the mounting brackets 14, 15 to allow the sharpening machine as a whole to be fitted closely against the front edge of a workbench constituting the support surface 26.

Figure 6:
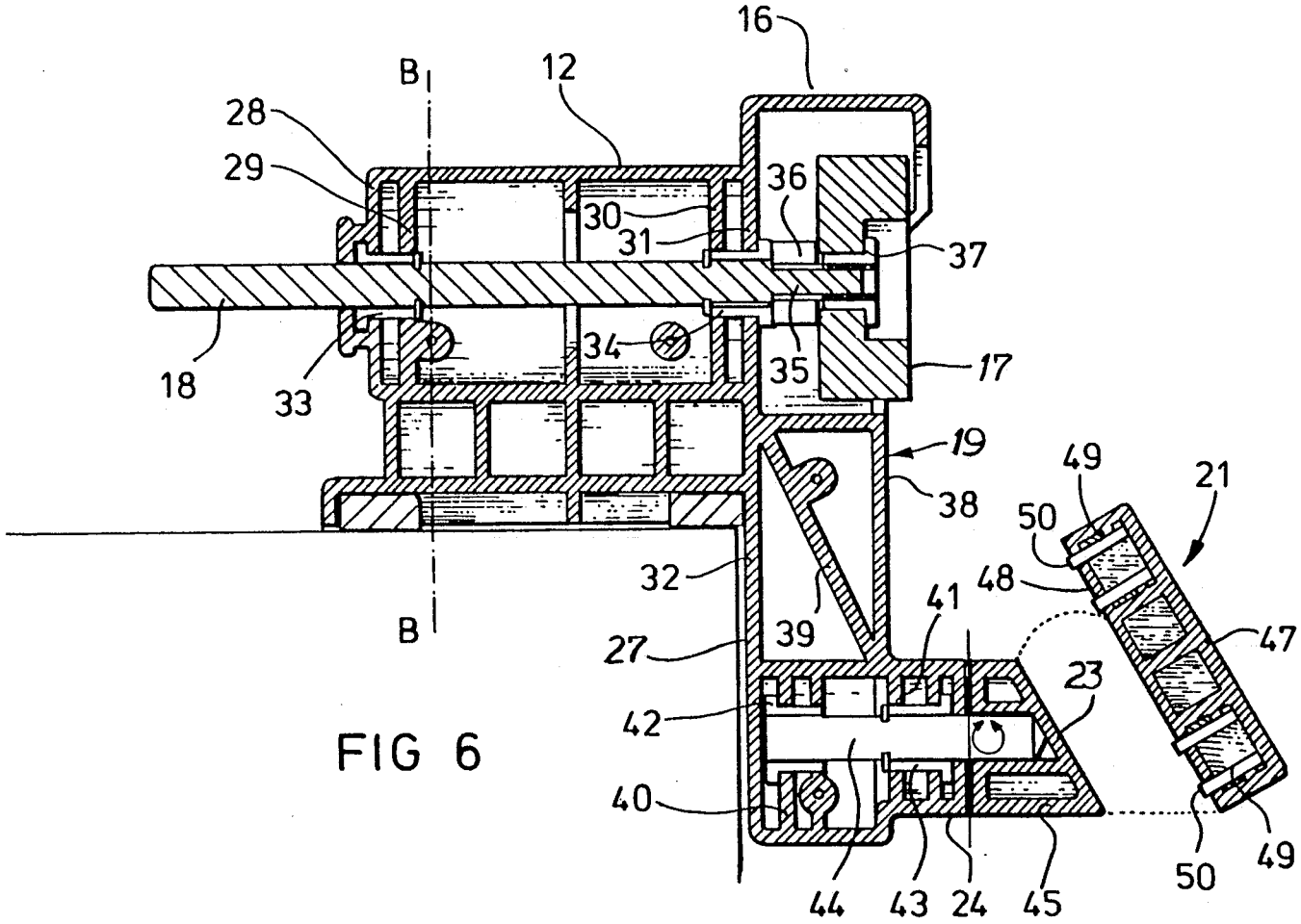
FIG. 6 is an axial section through the illustrated embodiment.

Referring now particularly to FIG. 6, the machine body 12 will be seen to comprise a hollow casing having two pairs of flat end support webs 28, 29 at the end remote from the stone casing 16 and 30, 31 at the end adjacent the stone casing 16. Indeed, the support web 31 can be considered as an integral member extending into the stone casing 16 and also having a downward projection 32 which constitutes the rear face 27 of the tool mount support 19. The two pairs of flat end support webs 28, 29 and 30, 31 each have respective aligned central apertures receiving respective plain bearings 33, 34 for carrying the stone spindle 18.

At the forward end of the stone spindle 18 there is a short, screw-threaded section 35 of reduced diameter on which is carried a bush 36 abutting at one face against the bearing 34 and constituting a support face against which the stone 17 is held by a screw-threaded retaining member 37.

Figure 5:
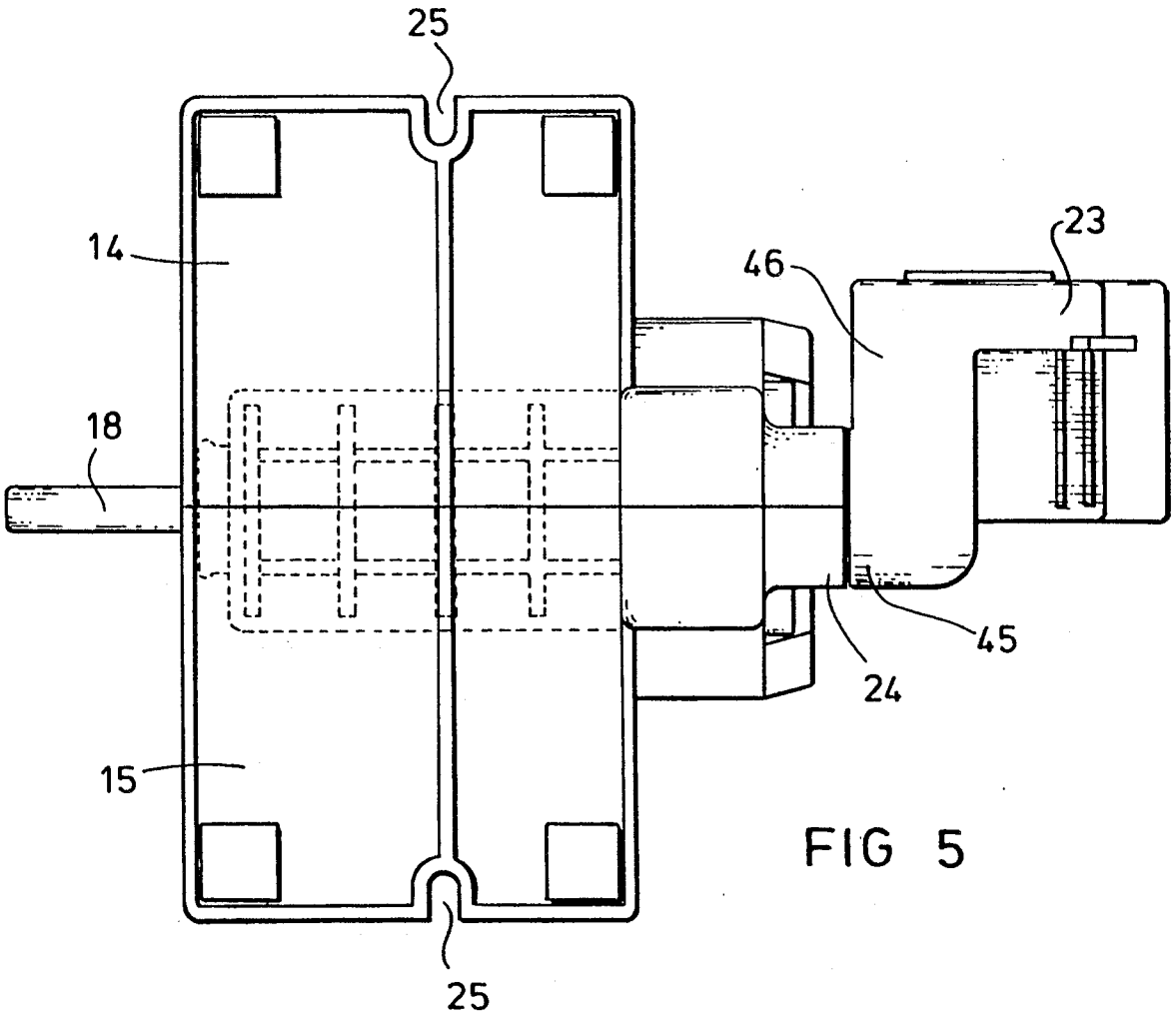
FIG. 5 is a plan view from below of the grinding apparatus illustrated in FIGS. 1 to 4.

The tool mount support 19 is itself a hollow section, again integrally moulded with the machine body 12, comprising the downward projection 32 constituting the rear face 27 as referred to above and a front web 38 reinforced internally by a diagonal bracing web 39. At its lower end the tool mount support 19 is moulded with a cylindrical boss constituting the tool mount spindle carrier 24 and this has a plurality of internal webs 40, 41 which provide supports for two coaxial aligned bearings 42, 43 for a tool mount spindle 44 a free end of which is force fitted into a tool mount boss 45 which, as will be seen from FIG. 5, is formed at the end of a cranked tool mount arm 46 which carries the tool holder plate support web 23 from which the tool holder plate 21 projects.

As will be seen in FIG. 6 the tool holder plate 21 is itself a hollow moulding having a front face 47 and a tool engagement face 48 into which project a plurality of strips 49 embedded into the tool holder plate 21 and the free edges 50 of which define an accurately inclined plane at 30° to the plane perpendicular to the axis of the spindle 18. The insert strips 49 may be made from magnetic material so that a ferromagnetic tool such as the tool 51 illustrated in FIGS. 3 and 4 placed against the tool engagement face 48 of the tool holder plate 21 is retained in contact therewith. Other forms of magnetic retainer may be formed for retention within the tool holder plate 21. Likewise, although described in a manner which defines a single unique plane at, in this case, 30° to plane defined by the axis of rotation of the spindle 18 (namely the flat face of the grindstone 17) other configurations, in particular one allowing an alteration of the angle of inclination of the tool holder plate 21 to at least one other angle, perhaps by adjusting the position of the insert strips 49, may be envisaged within the scope of the present invention.

In use of the tool described above a pistol drill or other drive source may be attached to the free end of the stone spindle 18 and energised to cause this to rotate in the bearings 33, 34 causing the stone 17 to rotate smoothly at high speed. The separation of the bearings 33, 34 ensures that the stone 17 rotates securely about the axis of the spindle 18 with no tendency to "wobble" or displace, even marginally, from a true plane. A tool, such as the chisel 51 illustrated in FIGS. 3 and 4, is then placed against the tool contact face 48 of the tool holder plate 21 with its edge in contact with the shoulder defined by the tool holder plate support web 23 thereby defining a single unique position for the tool. This can then be advanced towards the stone 17 by sliding the tool 51 in contact with the tool contact face 48 of the tool holder body 21, which movement is permitted by the magnetic interaction between the magnets 49 and the tool 51. When the edge of the tool 51 comes into contact with the flat face of the stone 17 the tool 51 can be rocked by turning it and the tool holder plate 21 about the axis of rotation of the tool mount spindle 44 which, because of the axial separation of the bearings 42, 43 is securely held against any rocking motion so that the edge of the tool can be moved certainly in a plane perpendicular to the axis of the spindle 44 which is accurately parallel to the spindle 18. In this sweeping motion of the edge of the tool across the grindstone face a flat bevel face is formed on the edge of the tool at an angle such that the line of intersection between the bevel face and the face in contact with the tool engagement face 48 of the tool holder plate 21 is accurately at right angles. This is ensured by the integral moulding of the whole of the machine body 12, the tool mount support 19 including the tool mount spindle carrier 24 as a unitary body.

If the amount of material removed during the first pass is found to be insufficient it is a simple matter to slide the tool slightly further along the tool mount 21 to engage the bevel face ground on the end of the tool again into contact with the flat face of the stone whereupon a sweep motion to and fro across the flat face of the stone will grind a small amount of material away from the bevel face thereby enlarging it. It will be appreciated that during this movement the whole of the flat annular face of the stone 17 is contacted by the bevel face of the tool 51 regardless of the size of the tool 51 so that the shape of the stone is not degraded as would be the case if only a part of the face were contacted, so that it can be anticipated that the stone will have a long service life between successive dressings.

Further, because of the simple manner in which the stone 17 is retained on the spindle 18 it is a simple matter for the operator to remove the screw threaded retaining member 37 to allow replacement of a new stone 17 should this become worn after a long service life.

What is claimed is:

1. Apparatus for sharpening an edge tool of the type comprising a substantially flat blade having a flat bevel face at an edge region thereof defining the cutting edge of the tool, comprising:

a rotary grindstone, means mounting the rotary grindstone so as to be rotatable about a first axis of rotation, tool mounting means for mounting an edge tool to be sharpened by grinding a flat face at an edge region thereof, said tool mounting means comprising:

a pivotable body turnable about a second axis of rotation orthogonal to said flat face ground on said edge tool upon contact with said rotary grindstone when turned about said second axis, means defining a flat tool engagement surface on said pivotable body, said tool engagement surface being inclined to said second axis of rotation by an angle defining the angle of said bevel face defining said cutting edge of said flat blade, and abutment shoulder means on said tool engagement surface for engagement by a lateral edge of said flat blade whereby to define a predetermined lateral position on said tool engagement surface of said flat blade.

2. The apparatus of claim 1, in which the tool mounting means includes a tool holder member having a tool engagement surface lying at a predetermined angle to the plane perpendicular to the said first axis of rotation of the rotary grindstone, whereby to define the angle of inclination of a tool on the tool mounting means in relation to the face of the rotary grindstone contacted by the edge of the tool as it is passed in contact with the rotary grindstone upon turning about the said second axis.

3. The apparatus of claim 2, in which said tool engagement surface of said tool holder member has a shoulder against which a lateral edge of the tool may abut to locate it in a predetermined lateral position on the tool mounting means.

4. The apparatus of claim 1, in which tool retaining means are provided for retaining a tool to be sharpened in contact with the said tool engagement surface of the tool holder means, the said tool retaining means permitting displacement of the tool with respect to the holder member parallel to the plane of the said tool engagement surface thereof whereby to adjust the proximity of the edge to be sharpened and the rotary grindstone for determining the amount of material removed as the tool is swept in contact with the grindstone.

5. The apparatus of claim 1, in which said rotary grindstone is supported for rotation by a machine body having brackets for attachment of the machine body to a support surface.

6. The apparatus of claim 1, in which the rotary grindstone is carried on a grindstone spindle a free end of which projects from bearing means therefor for attachment to a rotary drive device.

7. The apparatus of claim 1, in which the tool retaining means includes means for generating a magnetic attractive force between a ferromagnetic tool body and the said tool engagement surface of the tool holder.

8. The apparatus of claim 7, in which the said tool retaining mean comprise a permanent magnet.

9. The apparatus of claim 8, in which the tool mount is supported on the machine body for turning movement about the said second axis.

10. The apparatus of claim 1, in which the rotary grindstone is mounted on the output shaft of a drive motor for rotation therewith.

11. The apparatus of claim 1, in which the rotary grindstone is a circular disc-like stone having a circular recess in a major face thereof surrounded by a flat annular surface constituting the working face of the stone contacted by the edge tool to be sharpened in use of the apparatus.

* * * * *